US010138886B2

(12) United States Patent
Ashouri et al.

(10) Patent No.: US 10,138,886 B2
(45) Date of Patent: Nov. 27, 2018

(54) MICROFLUIDIC PUMP

(71) Applicants: Majid Ashouri, Tehran (IR); Mohammad Behshad Shafii, Tehran (IR); Ayda Shahriari, Tehran (IR)

(72) Inventors: Majid Ashouri, Tehran (IR); Mohammad Behshad Shafii, Tehran (IR); Ayda Shahriari, Tehran (IR)

( * ) Notice: Subject to any disclaimer, the term of this patent is extended or adjusted under 35 U.S.C. 154(b) by 416 days.

(21) Appl. No.: 14/968,340

(22) Filed: Dec. 14, 2015

(65) Prior Publication Data

US 2016/0319806 A1 Nov. 3, 2016

(51) Int. Cl.

| | |
|---|---|
| ***F04C 7/00*** | (2006.01) |
| ***F04B 19/00*** | (2006.01) |
| ***F04B 53/14*** | (2006.01) |
| ***F04C 15/00*** | (2006.01) |
| ***F04C 19/00*** | (2006.01) |

(52) U.S. Cl.

CPC ..... *F04C 15/0069* (2013.01); *F04B 19/006* (2013.01); *F04B 53/14* (2013.01); *F04C 15/0003* (2013.01); *F04C 7/00* (2013.01); *F04C 19/00* (2013.01); *F04C 2240/20* (2013.01)

(58) Field of Classification Search

CPC ..... F04B 17/00; F04B 17/03; F04B 19/006; F04B 19/20; F04B 19/22; F04B 39/0011; F04B 53/14–53/142; F04B 53/16; F04C 19/00; F04C 19/004; F04C 2240/20; F04C 29/0042–29/0085; F04C 7/00; F04C 15/0003–15/0038; F04C 15/0069; F04C 29/0064

USPC ..... 417/48, 50, 92–98, 322, 410.1, 420

See application file for complete search history.

(56) References Cited

U.S. PATENT DOCUMENTS

| | | | | |
|---|---|---|---|---|
| 664,507 | A * | 12/1900 | Singer | F04B 43/1238 417/476 |
| 2,250,947 | A * | 7/1941 | Carpenter, Jr. | F04B 1/0408 310/166 |
| 2,652,778 | A * | 9/1953 | Crever | F04D 7/065 310/11 |
| 2,915,973 | A * | 12/1959 | Findlay | H02K 44/06 198/619 |

(Continued)

FOREIGN PATENT DOCUMENTS

| | | | | |
|---|---|---|---|---|
| DE | 10313603 | A1 * | 6/2004 | F04B 15/04 |
| JP | 59224478 | A * | 12/1984 | F04B 43/088 |

(Continued)

*Primary Examiner* — Alexander B Comley

(57) ABSTRACT

A microfluidic pump composed of a cylindrical chamber, transfer ports having an inlet port and an outlet port positioned on the cylindrical chamber, a magnet member attached outside the cylindrical chamber, a magnetic piston in sliding communication with an inner wall of the cylindrical chamber, a magnetic material, and a valve member. The magnetic material self assembles to form a seal plug separating the inlet and outlet port, where the seal plug forms a link between the magnet member and the magnetic piston to rotate the magnetic piston along the inner wall of the cylindrical chamber, where a working fluid suctioned within the cylindrical chamber is discharged at the outlet port during a movement of the magnetic piston from the inlet to outlet port. The valve member positioned at the outlet port prevents the backflow of the working fluid towards the inlet port after the magnetic piston rotates past the outlet port.

13 Claims, 4 Drawing Sheets

(56) References Cited

U.S. PATENT DOCUMENTS

| | | | | | |
|---|---|---|---|---|---|
| 2,971,471 | A * | 2/1961 | Huebschman | A61H 23/0218 | 128/DIG. 3 |
| 3,038,409 | A * | 6/1962 | Edgerly | H02K 44/06 | 188/161 |
| 3,597,123 | A * | 8/1971 | Lutz | F04B 43/14 | 417/415 |
| 3,768,931 | A * | 10/1973 | Willis, Jr. | A61M 1/1053 | 417/322 |
| 4,332,534 | A * | 6/1982 | Becker | F04B 43/14 | 418/153 |
| 4,557,667 | A * | 12/1985 | Delassus | H02K 44/06 | 310/11 |
| 4,818,185 | A * | 4/1989 | Alexeff | H02K 44/02 | 310/11 |
| 5,286,176 | A * | 2/1994 | Bonin | F04B 43/123 | 417/322 |
| 8,267,669 | B2 * | 9/2012 | Kagan | F04B 15/02 | 417/50 |
| 8,568,113 | B2 * | 10/2013 | Pate | F04C 13/001 | 417/410.1 |
| 2004/0234392 | A1 * | 11/2004 | Ghoshal | F04B 17/044 | 417/410.1 |
| 2010/0268334 | A1 * | 10/2010 | Pate | A61M 1/101 | 623/3.14 |
| 2012/0070314 | A1 * | 3/2012 | Mueller | F04B 17/044 | 417/50 |
| 2014/0058190 | A1 * | 2/2014 | Gohean | A61M 1/1081 | 600/17 |

FOREIGN PATENT DOCUMENTS

| | | | | |
|---|---|---|---|---|
| JP | 60045788 | A * | 3/1985 | F04B 17/00 |
| JP | 60138294 | A * | 7/1985 | F04C 29/0085 |
| JP | 62265486 | A * | 11/1987 | F04C 19/004 |

* cited by examiner

MICROFLUIDIC PUMP

BACKGROUND OF THE INVENTION

The invention relates generally to microfluidic pumps.

With a growing interest in the development of microfluidic systems over the past two decades, there have been numerous reports on the design and fabrication of microfluidic devices for use in a wide range of applications, such as chemical analysis, biological and chemical sensing, drug delivery, molecular separation such as Deoxyribonucleic acid (DNA) analysis, amplification, sequencing or synthesis of nucleic acids, environmental monitoring, and also in precision control systems for automotive, aerospace and machine tool industries. The precise delivery of specific fluid volumes is an important challenge for a wide variety of micro-/milli-scale fluidic device designs. Pumping of coolant liquids through closed-loop compact heat exchanger systems could be advantageous for cooling of microelectronics, while reducing total package weight and volume.

There is a need in the art for a microfluidic pump which has a simple design and can be made easily and cheaply, and yet can also provide continuous high performance pumping, working at relatively low voltages, and at low-cost.

SUMMARY OF THE INVENTION

The invention relates generally to microfluidic pumps, and more specifically to revolving piston pump employing external magnetic actuations together with magnetic properties of magnetic fluids to pump fluid through cylindrical chambers.

One aspect of the present disclosure is directed to a microfluidic pump, comprising a generally cylindrical chamber; transfer ports comprising an inlet port and an outlet port circumferentially positioned on the cylindrical chamber; a magnet member fixedly attached outside the cylindrical chamber to generate a magnetic field within the cylindrical chamber; a magnetic piston positioned within and in sliding communication with an inner wall of the cylindrical chamber; a magnetic fluid contained within the cylindrical chamber, in the presence of the magnetic field, self assembles to form a seal plug connecting the magnetic piston with the magnet member, wherein the seal plug separates the inlet port from the outlet port, wherein the seal plug rotates the magnetic piston along the inner wall of the cylindrical chamber for suctioning a working fluid through the inlet port and discharging through the outlet port during one sweep of the magnetic piston from the inlet port to the outlet port; and a valve member positioned at the outlet port configured to prevent the backflow of the working fluid towards the inlet port after the magnetic piston rotates past the outlet port. In one embodiment, the number of inlet port or outlet port is at least one.

In one embodiment, the magnetic material connecting the magnet member and the magnetic piston is one of a magnetic fluid, a permanent magnet, and a paramagnetic substance which is situated within the magnetic field. In one embodiment, the magnetic material connecting the magnet member and the magnetic piston are connected by means of a magnetic fluid, a permanent magnet, or a paramagnetic substance which is situated within the magnetic field induced by the magnet member and the magnetic piston. In one embodiment, the seal plug is a slug of magnetic material which is held by an external stationary magnetic field produced by the magnet member. In one embodiment, one end of the seal plug is slidably attached in an upper section of the cylindrical chamber between the inlet and the outlet ports, and the other end is attached to the magnetic piston. In another embodiment, the revolving magnetic piston sweeps the cylindrical chamber counterclockwise from the inlet port to the outlet port displacing a volume of the working fluid to be pushed into the outlet port.

In another embodiment, the inlet port and the outlet port are provided free access with each other when the revolving magnetic piston approaches the shorter sector region between the inlet port and the outlet port positioned in the cylindrical chamber. In one embodiment, the valve member is configured to prevent backflow of the working fluid from the outlet port to the inlet port. In another embodiment, a contiguous ferrofluidic seal plug is formed between the magnetic piston and the stationary magnet member in the cylindrical chamber as the magnetic piston revolves. In one embodiment, the magnetic piston moves away from the region around the stationary magnet member, a portion of the magnetic fluid is affected by the field of the magnetic piston and sticks to the surface of the magnetic piston.

Another aspect of the present disclosure is directed to a magnetic piston-cylinder assembly of a microfluidic pump, comprising a magnetic piston positioned within and in sliding communication with an inner wall of a cylindrical chamber; a magnetic fluid contained within the cylindrical chamber, in the presence of the magnetic field, self assembles to form a seal plug connecting the magnetic piston with a magnet member positioned outside the cylindrical chamber, wherein the seal plug separates an inlet port from an outlet port of the cylindrical chamber, wherein the seal plug rotates the magnetic piston along the inner wall of the cylindrical chamber for suctioning a working fluid through the inlet port and discharging through the outlet port during one sweep of the magnetic piston from the inlet port to the outlet port.

In one embodiment, the seal plug moves along with the translating magnetic piston while another seal plug is always held in the small sector below the stationary magnet member. In another embodiment, the dimensions of the magnetic member generating the magnetic fields and the magnetic fluid is compatible to avoid separation of two seal plugs from each other and to sustain a thickness of the seal plug within the height of the cylindrical chamber.

In one embodiment, during a complete cycle of pumping, a net positive flow of the working fluid from the inlet port into the outlet port is equal to the volume of the cylindrical chamber excluding the spaces occupied by the magnetic piston and the ferrofluid. In another embodiment, the magnetic fluid is configured to block the section between the inlet port and the outlet port when the pressure gradient developed within the cylindrical chamber is below the force generated by the magnet member.

One aspect of the present disclosure is directed to a method of pumping a working fluid, comprising: providing a microfluidic pump, comprising: a generally cylindrical chamber; transfer ports comprising an inlet port and an outlet port circumferentially positioned on the cylindrical chamber, a magnet member fixedly attached outside the cylindrical chamber, a magnetic piston positioned within and in sliding communication with an inner wall of the cylindrical chamber, a magnetic fluid contained within the cylindrical chamber, and a valve member positioned at the outlet port; generating a magnetic field within the cylindrical chamber via the magnet member; self-assembling of the magnetic fluid in the presence of the magnetic field, to form a seal plug connecting the magnetic piston with the magnet member; separating the inlet port from the outlet port via the seal plug; rotating the magnetic piston along the inner wall of the cylindrical chamber via the seal plug for suctioning a working fluid through the inlet port; discharging the working fluid through the outlet port during one sweep of the magnetic piston from the inlet port to the outlet port; and preventing the backflow of the working fluid towards the inlet port after the magnetic piston rotates past the outlet port.

DETAILED DESCRIPTION OF THE INVENTION

Figure 1A:
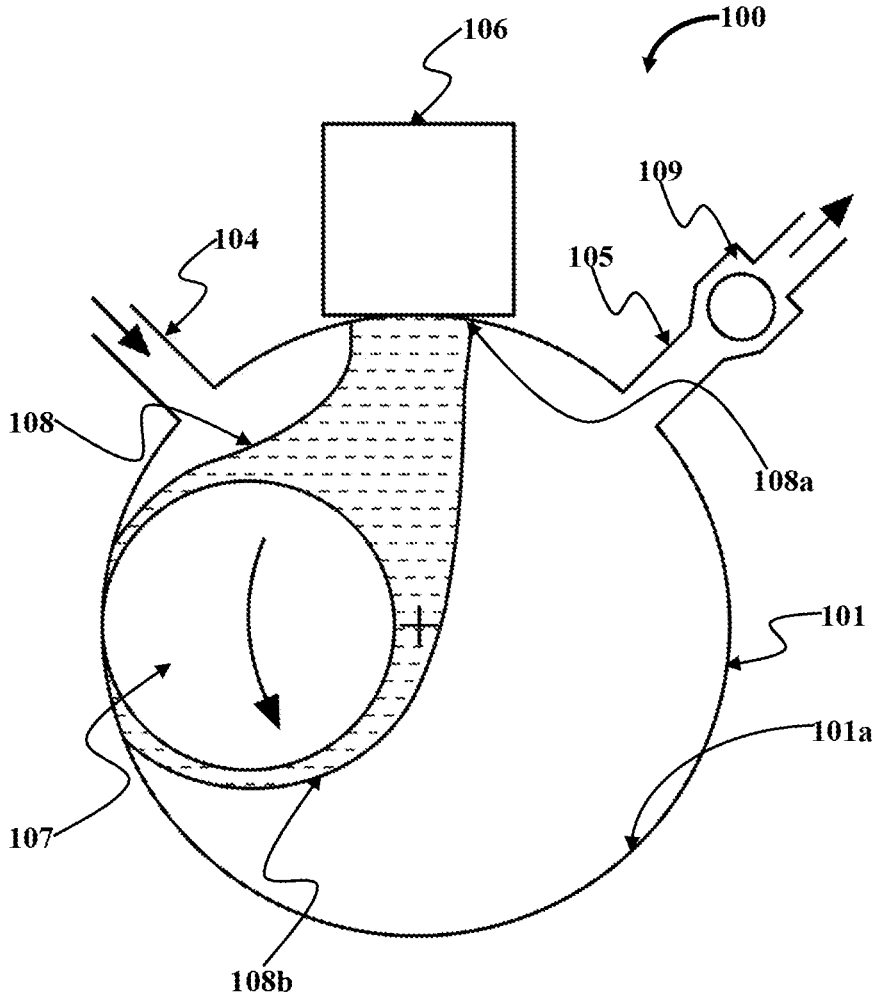
FIG. 1A exemplarily illustrates a schematic diagram of the microfluidic pump, showing an exhaust stroke of a working fluid.

The present invention describes a magnetically actuated miniature pump. The pumping is based on the peripheral displacement of a piston inside a circular cross section chamber. The piston is actuated using an external magnet. Magnetic fluid is employed to maintain sealing by filling the gaps between the disk and the chamber walls. Also, a combination of magnetic fluid and an external stationary magnet is used to form a physical barrier between the inlet and the outlet ports. The described mechanism introduces the first revolving piston pump. The piston revolves inside the chamber and sweeps the fluid ahead of it. With the avail of non-contact external actuation, this pump can be used in many applications when microfluidic systems need to be disposable and low-cost.

The microfluidic pump comprises a generally cylindrical chamber, transfer ports comprising an inlet port and an outlet port, a magnet member, a magnetic piston, a magnetic fluid, and a valve member. The inlet port and the outlet port are circumferentially positioned on the cylindrical chamber. The magnet member is fixedly attached outside the cylindrical chamber to generate a magnetic field within the cylindrical chamber. The magnetic piston is positioned within and in sliding communication with an inner wall of the cylindrical chamber. The magnetic material contained within the cylindrical chamber and magnetized from the magnetic field self assembles to form a seal plug separating the inlet port and the outlet port, where the seal plug separates the inlet port from the outlet port, where the seal plug rotates the magnetic piston along the inner wall of the cylindrical chamber for suctioning a working fluid through the inlet port and discharging through the outlet port during one sweep of the magnetic piston from the inlet port to the outlet port. The magnetic piston and the cylindrical chamber constitute a magnetic piston-cylinder assembly.

In an embodiment, the magnetic material connecting the magnet member and the magnetic piston is one of a magnetic fluid, a permanent magnet, or a paramagnetic substance which is situated within the magnetic field, induced by the magnet member and the magnetic piston. In an embodiment, the seal plug is slug of magnetic material which is held by an external stationary magnetic field produced by the magnet member, where one end of the seal plug is slidably attached in an upper section of the cylindrical chamber between the inlet and the outlet ports, and the other end is attached to the magnetic piston.

In an embodiment, the revolving magnetic piston sweeps the cylindrical chamber counterclockwise from the inlet port to the outlet port displacing a volume of the working fluid to be pushed into the outlet port. In an embodiment, the inlet port and the outlet port are unsealed from each other when the revolving magnetic piston approaches the region between the inlet port and the outlet port positioned in the cylindrical chamber, where the valve member is configured to prevent backflow of the working fluid from the outlet port to the inlet port.

In an embodiment, a contiguous ferrofluidic seal plug is formed between the magnetic piston and the stationary magnet member in the cylindrical chamber as the magnetic piston revolves. In an embodiment, when the magnetic piston moves away from the region around the stationary magnet member, a portion of the magnetic fluid is affected by the field of the magnetic piston and sticks to the surface of the magnetic piston.

Several micropumps have been developed for the purpose of microscale pumping of fluidic samples. Micropumps made of polymeric materials with contactless external actuations are of particular interest for disposable applications with the reusability of the costly parts of the device. In particular, magnetic actuation has the advantages of rapid time response with low actuation voltage as well as large displacement with the ability of self-priming. Several magnetically driven micropumps were presented based on deflection of elastic membranes with embedded permanent magnet using external electromagnets or external permanent magnets with controllable movement. The former actuation method has an issue of heating whereas the latter one has the advantage of lower input power.

On the other hand, most of the investigated pumping and valving devices are relatively complex and need expensive precision micromachining technologies. Among the microfabricated systems, ferrofluidic devices have the advantage of obviating the need for high-precision micromachined channels together with high-precision microfabricated moving parts, consequently reducing the cost as well as increasing the reliability. Ferrofluids, which are colloidal liquid made of nanosize ferromagnetic particles suspended in a carrier fluid, have the benefit of conforming to different channel shapes and providing self-sealing capability with low-friction motion responding to imposed magnetic fields.

Figure 1B:
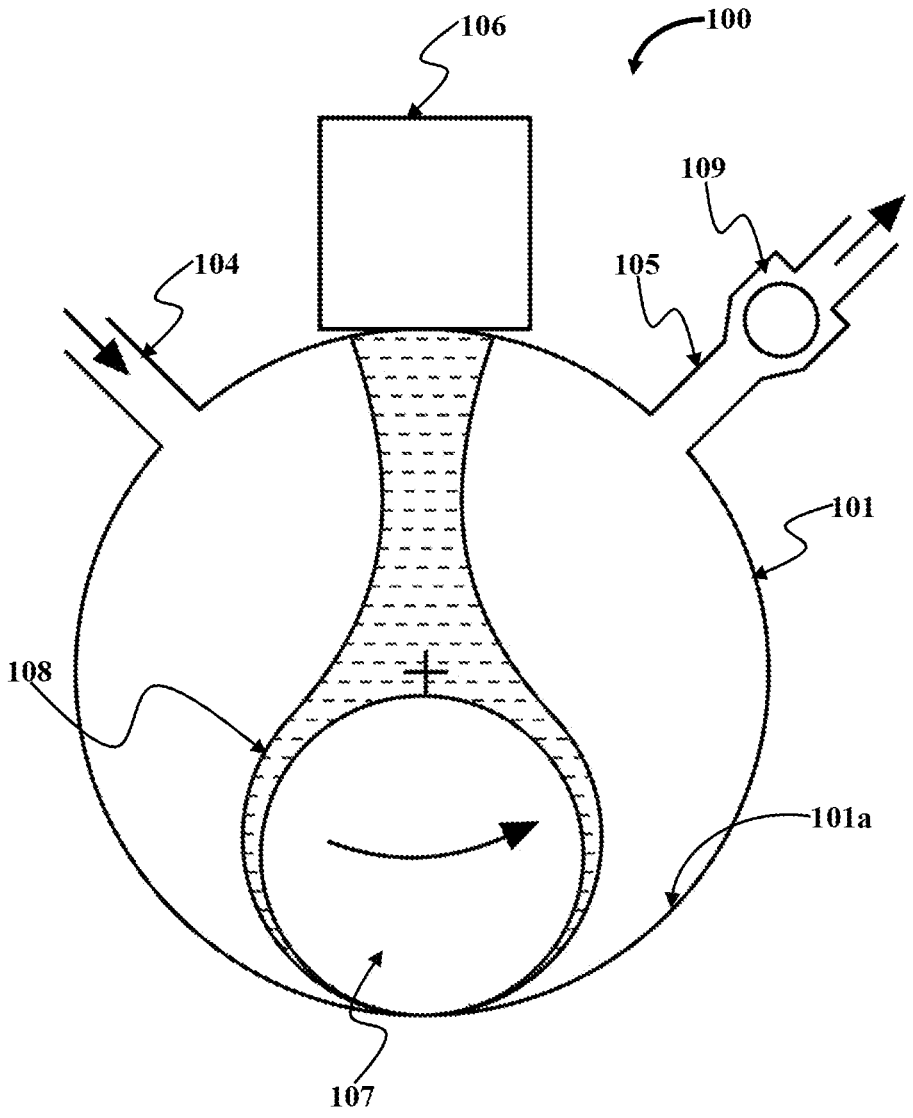
FIG. 1B exemplarily illustrates a schematic diagram of the microfluidic pump, showing a second position of the magnetic piston during the exhaust stroke of the working fluid.

FIGS. 1A-1B exemplarily illustrates a schematic diagram of the microfluidic pump 100, showing the working of the microfluidic pump 100 to exhaust a working fluid. The microfluidic pump 100 comprises a generally cylindrical chamber 101, transfer ports 103 comprising an inlet port 104 and an outlet port 105, a magnet member 106, a magnetic piston 107, a magnetic material, and a valve member 109. The inlet port 104 and the outlet port 105 are circumferentially positioned on the cylindrical chamber 101. In one embodiment, the number of inlet port 100 or outlet port 105 is at least one.

In one embodiment, the valve member 109 is not limited to the embodiment illustrated in FIG. 1. Particularly, the valve member 109 can be either located before the inlet port 104 or after the outlet port 105, or located in both the mentioned places. In other words, the valve member 109 can also be placed at the inlet side, or placed in both sides. In another embodiment, the valve member 109 can be one or more check valves. The valve member 109 can be, for example, a nozzle/diffuser element located before the inlet port 104 or after the outlet port 105 or located in both sides, for generating a unidirectional flow. In one embodiment, the valve member 109 can be any type of flow rectifying elements.

The magnet member 106 is fixedly attached outside the cylindrical chamber 101 to generate a magnetic field within the cylindrical chamber 101. The magnetic piston 107 is positioned within and in sliding communication with an inner wall 101*a* of the cylindrical chamber 101.

One aspect of the present disclosure is directed to a microfluidic pump. The microfluidic pump comprises a generally cylindrical chamber; and transfer ports comprising an inlet port and an outlet port circumferentially positioned on the cylindrical chamber. The microfluidic pump further comprises a magnet member fixedly attached outside the cylindrical chamber to generate a magnetic field within the cylindrical chamber; and a magnetic piston positioned within and in sliding communication with an inner wall of the cylindrical chamber.

A magnetic fluid contained within the cylindrical chamber, in the presence of the magnetic field, can assemble itself to form a seal plug connecting the magnetic piston with the magnet member, wherein the seal plug separates the inlet port from the outlet port. Further, the seal plug can rotate the magnetic piston along the inner wall of the cylindrical chamber for suctioning a working fluid through the inlet port and discharging through the outlet port during one sweep of the magnetic piston from the inlet port to the outlet port. The microfluidic pump further comprises a valve member positioned at the outlet port configured to prevent the backflow of the working fluid towards the inlet port after the magnetic piston rotates past the outlet port.

The magnetic material contained within the cylindrical chamber 101 and magnetized from the magnetic field self assembles to form a seal plug 108 separating the inlet port 104 and the outlet port 105, where the seal plug 108 separates the inlet port 104 from the outlet port 105, where the seal plug 108 rotates the magnetic piston 107 along the inner wall 101*a* of the cylindrical chamber 101 for suctioning a working fluid through the inlet port 104 and discharging through the outlet port 105 during one sweep of the magnetic piston 107 from the inlet port 104 to the outlet port 105. The valve member 109 positioned at the outlet port 105 prevents the backflow of the working fluid towards the inlet port 104 after the magnetic piston 107 rotates past the outlet port 105. The magnetic piston 107 and the cylindrical chamber 101 constitute a magnetic piston-cylinder assembly.

The magnetic material connecting the magnet member and the magnetic piston may be one of a magnetic fluid, a permanent magnet, or a paramagnetic substance which is situated within the magnetic field induced by the magnet member and the magnetic piston. Further, the seal plug can be a slug of magnetic material which is held by an external stationary magnetic field produced by the magnet member. One end of the seal plug can be slidably attached in an upper section of the cylindrical chamber between the inlet and the outlet ports, and the other end can be attached to the magnetic piston. Further, the revolving magnetic piston can sweep the cylindrical chamber counterclockwise from the inlet port to the outlet port displacing a volume of the working fluid to be pushed into the outlet port.

In an embodiment, the magnetic material connecting the magnet member 106 and the magnetic piston 107 is, for example, a magnetic fluid, a permanent magnet, or a paramagnetic substance which is situated within the magnetic field induced by the magnet member and the magnetic piston. In an embodiment, the seal plug 108 is slug of magnetic material which is held by an external stationary magnetic field produced by the magnet member 106, where one end 108*a* of the seal plug 108 is slidably attached in an upper section of the cylindrical chamber 101 between the inlet and the outlet ports 105 as shown in FIG. 1A, and the other end 108*b* is attached to the magnetic piston 107 as shown in FIG. 1A.

In an embodiment, the revolving magnetic piston 107 sweeps the cylindrical chamber 101 counterclockwise from the inlet port 104 to the outlet port 105 displacing a volume of the working fluid to be pushed into the outlet port 105. As shown in FIG. 1D, in an embodiment, the inlet port 104 and the outlet port 105 are provided free access with each other when the revolving magnetic piston 107 approaches the region between the inlet port 104 and the outlet port 105 positioned in the cylindrical chamber 101, where the valve member 109 is configured to prevent backflow of the working fluid from the outlet port 105 to the inlet port 104.

The pumping mechanism is based on, for example, the peripheral sliding motion of a magnetic body inside a cylinder. As shown in the schematic diagram in FIG. 1A, showing the working of the microfluidic pump 100. The microfluidic pump 100 consists of a cylindrical chamber 101 with one inlet port 104 and one outlet port 105, one valve member 109 at the outlet, and a revolving magnetic piston 107 inside the cylindrical chamber 101. The magnetic piston 107 is actuated using external magnetic field generated by the magnet member 106, for example, permanent magnet. For example, if the external magnetic field is mounted on a motor, the rotating shaft of the motor has its axis of rotation that matches with the centerline of the cylindrical chamber 101; however, it is eccentric with respect to the revolving magnetic piston 107.

The inlet port and the outlet port may be provided free access with each other when the revolving magnetic piston approaches the shorter sector region between the inlet port and the outlet port positioned in the cylindrical chamber. The valve member may be configured to prevent backflow of the working fluid from the outlet port to the inlet port. A contiguous ferrofluidic seal plug can be formed between the magnetic piston and the stationary magnet member in the cylindrical chamber as the magnetic piston revolves. Further, the present disclosure as the magnetic piston moves away from the region around the stationary magnet member, a portion of the magnetic fluid is affected by the field of the magnetic piston and sticks to the surface of the magnetic piston.

The seal plug can move along with the translating magnetic piston while another seal plug is always held in the small sector below the stationary magnet member. The present disclosure teaches that the dimensions of the magnetic member generating the magnetic fields and the magnetic fluid is compatible to avoid separation of two seal plugs from each other and to sustain a thickness of the seal plug within the height of the cylindrical chamber. In one example, during a complete cycle of pumping, a net positive flow of the working fluid from the inlet port into the outlet port is equal to the volume of the cylindrical chamber excluding the spaces occupied by the magnetic piston and the ferrofluid. In one aspect, the present disclosure teaches that the magnetic fluid is configured to block the section between the inlet port and the outlet port when the pressure gradient developed within the cylindrical chamber is below the force generated by the magnet member.

In an embodiment, the magnetic material connecting the magnet member 106 and the magnetic piston 107 is, for example, a magnetic fluid, a permanent magnet or a paramagnetic substance which is fully situated with magnetic field induced by the magnet member and the magnetic piston. In one embodiment, the external magnet member 106 can be one single permanent magnet, an array of permanent magnets, one single electromagnet, or an array of electromagnets; this is also true for the element which externally actuates the magnetic piston 107.

In an example, serving as the sliding vane in a "roller compressor", in an embodiment, the seal plug 108 is slug of magnetic fluid which is held by an external stationary magnetic field produced by the magnet member 106, wherein one end 108*a* of the seal plug 108 is slidably attached in an upper section of the cylindrical chamber 101 between the inlet and the outlet ports 105, and the other end 108*b* is attached to the magnetic piston 107.

As exemplarily illustrated in FIG. 1D, the microfluidic pump 100 does not require an inlet valve but requires an outlet valve member 109. The sealing between the high and low pressure sides has to be provided along the line of contact between the piston and the inner wall 101*a* of the cylindrical chamber 101, or the cylinder block, that is along a line starting from the small sector between the inlet port 104 and the outlet port 105 to the magnetic piston 107 as well as the magnetic piston 107 and the end plates of the cylindrical chamber 101.

In an embodiment, the magnetic fluid is configured to block the section between the inlet port 104 and the outlet port 105 when the pressure gradient developed within the cylindrical chamber 101 is below the force generated by the magnet member 106, that is, as long as the force imposed by the pressure gradient does not exceed the force generated by the external stationary magnet member 106, the ferrofluid or the magnetic material will block the section between the inlet port 104 and the outlet port 105.

Another aspect of the present disclosure is directed to a magnetic piston-cylinder assembly of a microfluidic pump. This assembly comprises a magnetic piston positioned within and in sliding communication with an inner wall of a cylindrical chamber; and a magnetic fluid contained within the cylindrical chamber. In the presence of the magnetic field, the magnetic fluid can assemble itself to form a seal plug connecting the magnetic piston with a magnet member positioned outside the cylindrical chamber, wherein the seal plug separates an inlet port from an outlet port of the cylindrical chamber. The seal plug can rotate the magnetic piston along the inner wall of the cylindrical chamber for suctioning a working fluid through the inlet port and discharging through the outlet port during one sweep of the magnetic piston from the inlet port to the outlet port.

In general, a ferrofluid is always exposed to the magnetic fields of all the magnets. Therefore, as illustrated in FIG. 1, in an embodiment, a contiguous ferrofluidic slug or the seal plug 108 will be formed between the magnetic piston 107 and the stationary magnet member 106 in the cylindrical chamber 101 as magnetic piston 107 revolves. When the magnetic piston 107 moves away from the region around the stationary magnet member 106, a portion of the ferrofluid is more strongly affected by the field of the magnetic piston 107 and sticks to the surface of the magnetic piston 107. Therefore, the seal plug portion 108*b* of ferrofluid goes along with the translating magnetic piston 107 while another seal plug portion 108*a* is always held in the small sector below the stationary magnet member 106. The dimensions of the magnet member 106 generating the magnetic fields and the magnetic fluid is compatible as to never let the two seal plug portions 108*a* and 108*b* of ferrofluid separate from each other as well as sustaining a predetermined thickness of the seal plug 108 within the height of the cylindrical chamber 101. The functional principle of the microfluidic pump 100 is schematically described in FIG. 1.

Figure 1C:
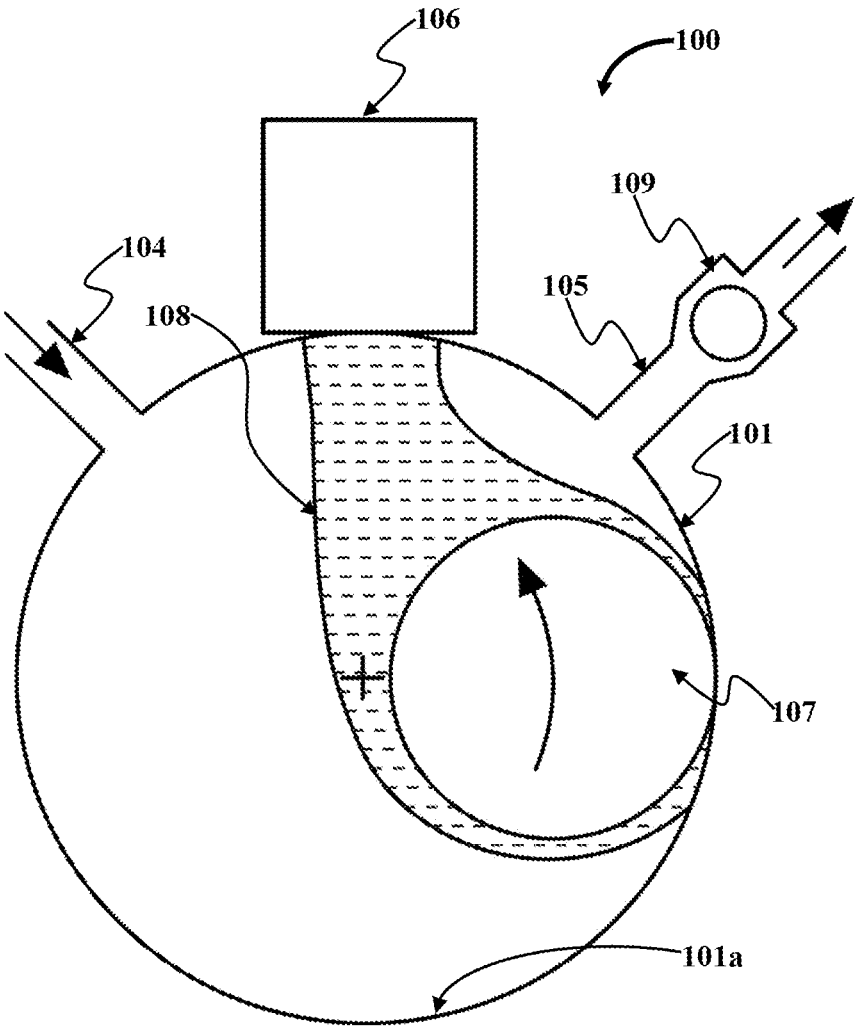
FIG. 1C exemplarily illustrates a schematic diagram of the microfluidic pump, showing a third position of the magnetic piston during the exhaust stroke of the working fluid.
Figure 1D:
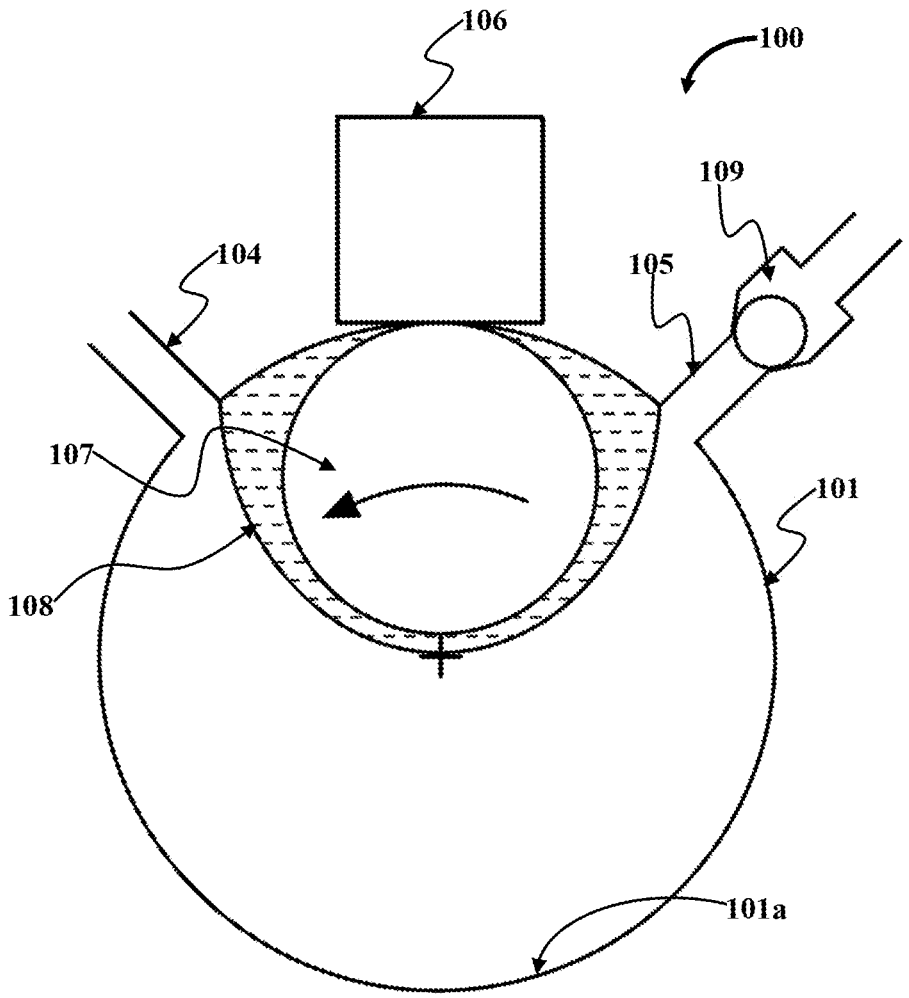
FIG. 1D exemplarily illustrates a schematic diagram of the microfluidic pump, showing the magnetic piston positioned on the region between the inlet port and the outlet port.

Here, there are two distinct situations for the pumping phases based on the location of the revolving magnetic piston 107: the case when the revolving piston is sweeping the larger sector between the inlet and the outlet ports 105 as illustrated in FIGS. 1A-1C, and the case when it is confined to the small sector between the inlet port 104 and the outlet port 105 as illustrated in FIG. 1D.

In the first case, in an embodiment, the revolving magnetic piston 107 sweeps the cylindrical chamber 101 counterclockwise from the inlet port 104 to the outlet port 105 as shown in FIGS. 1A-1C. As the result, the displaced volume of the working fluid will be pushed into the outlet port 105. In the second case, as it is shown in FIG. 1D, by approaching the revolving magnetic piston 107 to the region between the inlet port 104 and the outlet port 105 positioned in the cylindrical chamber 101, they become accessible to the inlet port 104 and the outlet port 105 through the portion of the cylindrical chamber 101 at opposite side of the stationary permanent magnet member 106.

In this situation, the valve member 109 located after the outlet will resist the working fluid from flowing reversely from the outlet port 105 to the inlet port 104. So, during the second phase, there is no significant reverse flow of working fluid through the microfluidic pump 100. Therefore, in an embodiment, in a complete cycle of pumping using the microfluidic pump 100, a net positive flow of the working fluid from the inlet port 104 into the outlet port 105 is equal to the volume of the cylindrical chamber 101 excluding the spaces occupied by the magnetic piston 107 and the ferrofluid. The microfluidic pump 100 does not require precision microfabrication with small-clearance moving magnetic piston 107.

In short, the microfluidic pump 100 provides ease of manufacture even if fabricated in smaller scales, easy and uncomplicated actuation, and the capability of the pump body to be disposable in light expense due to the external actuation. In one embodiment, microfluidic pump 100 is used with liquid fluids, aqueous media, or fluids that are gases. In one example, the ferrofluid/magneto-rheological-fluid component is a ferrofluid/magneto-rheological fluid immiscible to the working fluid.

One aspect of the present disclosure is directed to a method of pumping a working fluid. The method comprises providing a microfluidic pump that comprises a generally cylindrical chamber and transfer ports. The method further comprises generating a magnetic field within the cylindrical chamber via the magnet member; self-assembling of the magnetic fluid in the presence of the magnetic field to form a seal plug connecting the magnetic piston with the magnet member; and separating the inlet port from the outlet port via the seal plug.

The method of pumping a working fluid further comprises rotating the magnetic piston along the inner wall of the cylindrical chamber via the seal plug for suctioning a working fluid through the inlet port; discharging the working fluid through the outlet port during one sweep of the magnetic piston from the inlet port to the outlet port; and preventing the backflow of the working fluid towards the inlet port after the magnetic piston rotates past the outlet port. The transfer ports may comprise an inlet port and an outlet port circumferentially positioned on the cylindrical chamber, a magnet member fixedly attached outside the cylindrical chamber, a magnetic piston positioned within and in sliding communication with an inner wall of the cylindrical chamber, a magnetic fluid contained within the cylindrical chamber, and a valve member positioned at the outlet port.

The foregoing examples have been provided merely for the purpose of explanation and are in no way to be construed as limiting of the present concept disclosed herein. While the concept has been described with reference to various embodiments, it is understood that the words, which have been used herein, are words of description and illustration, rather than words of limitation. Further, although the concept has been described herein with reference to particular means, materials, and embodiments, the concept is not intended to be limited to the particulars disclosed herein; rather, the concept extends to all functionally equivalent structures, methods and uses, such as are within the scope of the appended claims. Those skilled in the art, having the benefit of the teachings of this specification, may affect numerous modifications thereto and changes may be made without departing from the scope and spirit of the concept in its aspects.

What is claimed is:

1. A microfluidic pump, comprising;

a generally cylindrical chamber;

transfer ports comprising an inlet port and an outlet port circumferentially positioned on the cylindrical chamber;

a magnet member fixedly attached outside the cylindrical chamber to generate a magnetic field within the cylindrical chamber;

a magnetic piston positioned within and in sliding communication with an inner wall of the cylindrical chamber;

a magnetic fluid contained within the cylindrical chamber that, in the presence of the magnetic field, self assembles to form a seal plug connecting the magnetic piston with the magnet member, wherein the seal plug separates the inlet port from the outlet port, wherein the seal plug rotates the magnetic piston along the inner wall of the cylindrical chamber for suctioning a working fluid through the inlet port and discharging the working fluid through the outlet port during one sweep of the magnetic piston from the inlet port to the outlet port; and a valve member positioned at the outlet port configured to prevent backflow of the working fluid towards the inlet port after the magnetic piston rotates past the outlet port.

2. The microfluidic pump of claim 1, wherein the seal plug is a slug of magnetic material which is held by a stationary magnetic field produced by the magnet member.

3. The microfluidic pump of claim 2, wherein one end of the seal plug is slidably attached in an upper section of the cylindrical chamber between the inlet and the outlet ports, and another end is attached to the magnetic piston.

4. The microfluidic pump of claim 1, wherein the magnetic piston sweeps the cylindrical chamber counterclockwise from the inlet port to the outlet port displacing a volume of the working fluid to be pushed into the outlet port.

5. The microfluidic pump of claim 1, wherein the inlet port and the outlet port provide free access with each other when the rotating magnetic piston approaches a region between the inlet port and the outlet port positioned in the cylindrical chamber.

6. The microfluidic pump of claim 5, wherein the valve member is configured to prevent backflow of the working fluid from the outlet port to the inlet port.

7. The microfluidic pump of claim 1, wherein the seal plug is formed contiguously between the magnetic piston and the magnet member in the cylindrical chamber as the magnetic piston rotates.

8. The microfluidic pump of claim 7, wherein when the magnetic piston moves away from the magnet member, a portion of the magnetic fluid is affected by a magnetic field of the magnetic piston and sticks to the magnetic piston.

9. The microfluidic pump of claim 8, wherein a portion of the seal plug moves along with the rotating magnetic piston while another portion of the seal plug is always held in a region below the magnet member.

10. The microfluidic pump of claim 9, wherein dimensions of the magnetic member generating the magnetic field and the magnetic fluid are compatible to avoid separation of two seal plugs from each other and to sustain a thickness of the seal plug within a height of the cylindrical chamber.

11. The microfluidic pump of claim 1, wherein, during a complete cycle of pumping, a net positive flow of the working fluid from the inlet port into the outlet port is equal to a volume of the cylindrical chamber excluding spaces occupied by the magnetic piston and the magnetic fluid.

12. A magnetic piston-cylinder assembly of a microfluidic pump, comprising:

a magnetic piston positioned within and in sliding communication with an inner wall of a cylindrical chamber;

a magnetic fluid contained within the cylindrical chamber that, in the presence of a magnetic field, self assembles to form a seal plug connecting the magnetic piston with a magnet member positioned outside the cylindrical chamber, wherein the seal plug separates an inlet port from an outlet port of the cylindrical chamber, wherein the seal plug rotates the magnetic piston along the inner wall of the cylindrical chamber for suctioning a working fluid through the inlet port and discharging through the outlet port during one sweep of the magnetic piston from the inlet port to the outlet port.

13. A method of pumping a working fluid, comprising;

providing a microfluidic pump, comprising:

a generally cylindrical chamber;

transfer ports comprising an inlet port and an outlet port circumferentially positioned on the cylindrical chamber;

a magnet member fixedly attached outside the cylindrical chamber;

a magnetic piston positioned within and in sliding communication with an inner wall of the cylindrical chamber;

a magnetic fluid contained within the cylindrical chamber; and a valve member positioned at the outlet port;

generating a magnetic field within the cylindrical chamber via the magnet member;

self-assembling the magnetic fluid in the presence of the magnetic field, to form a seal plug connecting the magnetic piston with the magnet member;

separating the inlet port from the outlet port via the seal plug;

rotating the magnetic piston along the inner wall of the cylindrical chamber via the seal plug for suctioning a working fluid through the inlet port;

discharging the working fluid through the outlet port during one sweep of the magnetic piston from the inlet port to the outlet port; and preventing backflow of the working fluid towards the inlet port after the magnetic piston rotates past the outlet port.

* * * * *